US011998044B2

(12) United States Patent
Whyte

(10) Patent No.: US 11,998,044 B2
(45) Date of Patent: Jun. 4, 2024

(54) INHALATION APPARATUS FOR PARTICULATE FILTRATION

(71) Applicant: Lucid Ganja LLC, Atlanta, GA (US)

(72) Inventor: Cameron Whyte, Atlanta, GA (US)

(73) Assignee: Cameron Whyte, Atlanta, GA (US)

( * ) Notice: Subject to any disclaimer, the term of this patent is extended or adjusted under 35 U.S.C. 154(b) by 286 days.

(21) Appl. No.: 17/381,280

(22) Filed: Jul. 21, 2021

(65) Prior Publication Data

US 2023/0025578 A1 Jan. 26, 2023

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS

| | | | | |
|---|---|---|---|---|
| 3,863,646 | A | 2/1975 | Kahler | |
| 3,872,872 | A | 3/1975 | Kahler | |
| 4,031,904 | A | 6/1977 | Karl | |
| 4,116,204 | A | 9/1978 | Kline | |
| 4,244,383 | A | 1/1981 | Kahler | |
| 7,806,123 | B2 | 10/2010 | Mehio | |
| 2015/0374032 | A1* | 12/2015 | De Gaglia | A24F 1/30 131/225 |
| 2020/0352222 | A1* | 11/2020 | Larsen | F16L 55/115 |
| 2022/0312835 | A1* | 10/2022 | Cummings | A24F 1/30 |

* cited by examiner

*Primary Examiner* — Dennis R Cordray
(74) *Attorney, Agent, or Firm* — Taft Stettinius & Hollister LLP; Jessamine G. Pilcher

(57) ABSTRACT

An apparatus for use as a water pipe configured to be disassembled and assembled.

15 Claims, 7 Drawing Sheets

INHALATION APPARATUS FOR PARTICULATE FILTRATION

TECHNICAL FIELD

The present disclosure relates generally to a water pipe for filtering smoke and more particularly to an improved water pipe that is configured to be disassembled for cleaning and reassembled for use.

BACKGROUND

Smoking pipes or bongs (also referred to as a water pipes) have been generally used for filtering smoke from the smoking of tobacco by transmitting the smoke from the bowl where the tobacco is burned through a conduit called a stem into a container of water, which performs a filtering function. The smoke is then transmitted by suction applied by the user through the neck of the bong to the user's mouth.

Historically, these apparatuses generally included one or more flexible hoses, which have a tendency to become clogged up as a result of the materials found in smoke, which passes through them. Further, basic water pipes are manufactured as a single component making it difficult access to clean and inspect the interior surface. In addition, often some components of the pipe such as the stem or bowl, or the entire pipe, must be discarded due to the unsanitary conditions arising from the difficulty of cleaning its internal surfaces.

Prior attempts of addressing the above issue(s) have resulted in failures because they are not user friendly and/or tend to result in the pipe losing structural integrity over time. Accordingly, a need exists for an improved water pipe that is easy to clean, maintains structural integrity, and is user friendly.

SUMMARY

With every use of a water pipe, a film has a chance to form on the internal surfaces of the pipe, e.g. the interior walls of the neck, joint, or vessel containing liquid. This film is a suitable substrate for microbes such as bacteria, yeast, mold, and fungus to reproduce. A user risks breathing in harmful microbes if the pipe is not properly cleaned. The joint, neck, and chamber where smoke is filtered, and/or passes through, are the components most often to develop a biofilm and tar buildup. These are also difficult components to access and clean. The improved apparatus described herein allows a user to access these notorious sections of the water pipe because, among other things, the sections are provided as individual components capable of being easily assembled and disassembled.

According to one aspect of the disclosure, the apparatus formed from components including a tube, a chamber, and a base is provided. Each of these components is configured to be separable or removably secured so that the apparatus may be easily assembled and disassembled. When assembled, the apparatus includes an internal portion formed from the internal surfaces and configured to act as a watertight vessel for filtering smoke. When disassembled, the components are easily cleaned and inspected. Finally, the components include structural elements and materials that withstand forces, temperature changes, pressure, and exposure to cleaning solvents to extend the life of the apparatus.

The components of the apparatus are coupled together at attachment points. The attachment point includes a fastener system having a donor (historically referred to as the male end) and the acceptor (historically referred to as the female end). In application, the donor is located on one component and the acceptor is located on the other component. Together the two are configured to removably secure the two components to form a watertight seal. In one aspect, when the fastener system includes complementary threading, the threading disposed externally on a component is a donor and the threading disposed internally in a component is an acceptor.

Methods of assembling, disassembling, and cleaning are also provided. Additionally, a kit is provided for packaging and shipping the apparatus to a customer.

Additional Embodiments are also contemplated.

Clause 1. An apparatus comprising: i) a tube having an inlet and an outlet, ii) a chamber having a top and a bottom, and iii) a base; wherein the base is configured to be separable from the bottom of the chamber and the top of the chamber is configured to be separable from the inlet; and wherein the apparatus is configured to be disassembled.

Clause 2. An apparatus configured to be disassembled and reassembled for use including: i) a tube having an inlet and an outlet; ii) a chamber having a top and a bottom, wherein the inlet is configured to couple to the top of the base; iii) a joint extending outwardly from the chamber, wherein the joint defines a conduit in fluid communication with the chamber; and iv) a base having a top opening and an enclosed bottom located opposite the top opening, wherein the base is configured to couple to the bottom of the chamber.

Clause 3. The apparatus of clauses 1 and 2, wherein the top of the chamber has an opening configured to couple to the inlet of the tube and the bottom of the chamber has an opening configured to couple to the top opening of the base.

Clause 3. The apparatus of any of the preceding clauses, wherein the apparatus is formed from a non-porous material.

Clause 4. The apparatus of any of the preceding clauses, wherein the apparatus comprises a polymer, a metal, or a combination thereof.

Clause 5. The apparatus of any of the preceding clauses, wherein the apparatus comprises glass, or plastic such as polycarbonate or acrylic, or a combination thereof.

Clause 6. The apparatus of any of the preceding clauses, wherein the apparatus is formed from a material configured to withstand heat of up to about 160° C. and pressure greater than about 0.5 psi.

Clause 7. The apparatus of any of the preceding clauses, wherein the tube further includes a donor or acceptor connected to the inlet of the tube.

Clause 8. The apparatus of clause 7, wherein the donor or acceptor includes threading.

Clause 9. The apparatus of clause 8, wherein the threading is disposed internally in the tube.

Clause 10. The apparatus of clause 8, wherein the threading is disposed externally on the tube.

Clause 11. The apparatus of any of the preceding clauses, wherein the chamber includes a donor or acceptor connected to the top of the chamber, and a donor or acceptor connected to the bottom of the chamber.

Clause 12. The apparatus of clause 11, wherein the donor or acceptor at the top of the chamber and the donor or acceptor at the bottom of the chamber both include threading.

Clause 13. The apparatus of clause 12, wherein the threading connected to the top of the chamber is disposed externally.

Clause 14. The apparatus of clause 12, wherein the threading connected to the bottom of the chamber is disposed externally.

Clause 15. The apparatus of clause 12, wherein the threading connected to the top of the chamber is disposed internally.

Clause 16. The apparatus of clause 12, wherein the threading connected at the bottom of the chamber is disposed internally.

Clause 17. The apparatus of clauses 11-16, wherein the donor or acceptor connected to the inlet of the tube is configured to secure to the donor or acceptor connected to the top of the chamber.

Clause 18. The apparatus of clause 17, wherein the inlet of the tube is connected and secured to the top of the chamber by interconnecting the threading disposed on the inlet and the threading disposed on the top of the chamber.

Clause 19. The apparatus of clause 18, wherein the threading disposed on the inlet and the threading disposed on the top of the chamber are complementary.

Clause 20. The apparatus of any of clauses 7-19, wherein the tube is configured to be separable from the chamber by rotation about an axis.

Clause 21. The apparatus of clauses 2-20, wherein the base includes a donor or acceptor connected to the top of the base and the donor or acceptor forms an annular opening.

Clause 22. The apparatus of any of the preceding clauses, wherein the base opening is configured to align with the bottom opening of the chamber.

Clause 23. The apparatus of clauses 21 or 22, wherein the base donor or acceptor includes threading connected to the top of the base.

Clause 24. The apparatus of clause 23, wherein the threading is disposed internally on the base.

Clause 25. The apparatus of clause 23, wherein the threading is disposed externally on the base.

Clause 26. The apparatus of clause 23, wherein the threading connected to the base is configured to interconnect with the threading at the bottom of the chamber.

Clause 27. The apparatus of clause 26, wherein the base and the chamber are configured to be separable from each other.

Clause 28. The apparatus of clause 26, wherein the threading disposed on the base and the threading disposed on the bottom of the chamber are complementary.

Clause 29. The apparatus of clauses 21-28, wherein the donor or acceptor disposed on the base is configured to be separable from the donor or acceptor disposed on the bottom of the chamber.

Clause 30. The apparatus of clause 29, wherein the base and the chamber may be separated by rotation about an axis.

Clause 31. The apparatus of clauses 8-30, wherein the donor or acceptor further comprises a gasket to generate a watertight seal.

Clause 32. The apparatus of clauses 2-31, wherein the joint is configured to receive a stem.

Clause 33. The apparatus of clause 32, wherein the stem is made of glass.

Clause 34. The apparatus of clause 33, wherein the stem is configured to receive a bowl.

Clause 35. The apparatus of clause 34, wherein the bowl is made of glass.

Clause 36. The apparatus of any of the preceding clauses, wherein the tube includes a body having uniform thickness throughout the length of the body.

Clause 37. The apparatus of any of the preceding clauses, wherein the donor or acceptor connected to the top the chamber is annular and configured to form an opening capable of coupling to the donor or acceptor connected to inlet of the tube.

Clause 38. The apparatus of any of the preceding clauses, wherein the donor or acceptor connected to the bottom of the chamber is annular and configured to form an opening capable of coupling to the donor or acceptor connected to the base.

Clause 39. The apparatus of any of the preceding clauses, wherein the donor or acceptor connected to the top of the chamber includes a smaller diameter than the donor or acceptor to the bottom of the chamber.

Clause 40. The apparatus of any of the preceding clauses, wherein the tube inlet is configured for receiving the top of the chamber and the base is configured to receive the bottom of the chamber.

Clause 41. The apparatus of any of the preceding clauses, wherein the chamber includes a donor or acceptor connected to the top of the chamber and a donor or acceptor connected to the bottom of the chamber.

Clause 42. The apparatus of clause 41, wherein the tube includes a donor or acceptor connected to the inlet and the base includes a donor or acceptor connected to the top of the base, wherein the chamber is configured to be separably coupled to an inlet donor or acceptor and base donor or acceptor.

Clause 43. The apparatus of clauses 7, 11, 17, and 21, wherein the fastener system is a twist and lock mechanism, threading including at least two, at least three, at least four, at least five, or at least six threads, a suction mechanism, a spring mechanism, magnets or a combination thereof.

Clause 44. The apparatus of any of the preceding clauses, wherein the tube, the chamber, and the base are configured to each maintain structural integrity while being secured together and unsecured from each other.

Clause 45. The apparatus of any of the preceding clauses, wherein the tube has a uniform circumference along the length of tube's body.

Clause 46. The apparatus of any of the preceding clauses, wherein the outlet of the tube includes an annular lip surrounding the outlet.

Clause 47. The apparatus of any of the preceding clauses, wherein the chamber separably couples internally to the tube.

Clause 48. The apparatus of any of the preceding clauses, wherein the chamber separably couples internally to the base.

Clause 49. The apparatus of any of the preceding clauses, wherein the tube has a length of about 5 millimeters (mm) to about 1000 millimeters and a diameter of about 25 millimeters to about 125 millimeters.

Clause 50. The apparatus of any of the preceding clauses, wherein the base has a height of about 5 millimeters to about 160 millimeters and a width of about 25 millimeters to about 310 millimeters.

Clause 51. The apparatus of any of the preceding clauses, wherein the top of the chamber has a diameter of about 25 millimeters to about 125 millimeters.

Clause 52. The apparatus of any of the preceding clauses, wherein the bottom of the chamber has a diameter of between about 25 millimeters to about 310 millimeters.

Clause 54. The apparatus of any of the preceding clauses, wherein the base top opening includes a diameter of about equal to the diameter of the bottom of the chamber.

Clause 55. The apparatus of any of the preceding clauses, wherein the base coupled to the chamber is configured to hold a volume of liquid up to about 500 cubic milliliters ($mL^3$).

Clause 56. The apparatus of any of the preceding clauses, wherein the donor or acceptor disposed on the inlet, the top of the chamber, the bottom of the chamber, and the top of the base is configured to withstand a force of up to about 70 Newtons when each is connected to another or disconnected from another.

Clause 57. A method of assembling the apparatus as described in any of the preceding clauses, comprising: i) connecting the chamber having a donor or acceptor to the base having a donor or acceptor; ii) rotating the base or chamber to interconnect the donor and acceptor forming a fastener systems; iii) connecting the chamber having a donor or acceptor to the tube having a donor or acceptor; iv) rotating the chamber or tube to interconnect forming a second fastener system.

Clause 58. A method of disassembling the apparatus as described in any of the preceding clauses, comprising: i) rotating the tube or chamber while keeping the other stationary to disconnect the fastener system; ii) separating the tube from the chamber; iii) rotating the base or chamber while keeping the other stationary to disconnect the second fastener system; and iv) separating the chamber and the base.

Clause 59. A method of cleaning the apparatus described in any of the preceding clauses comprising: i) subjecting the disassembled apparatus including the tube, base, and chamber to a cleaning mechanism.

Clause 60. The method of clause 59, wherein the cleaning mechanism is selected from an ultraviolet light, a dishwasher, an autoclave, a vessel containing water, vinegar, lemon, or dish soap, or a combination thereof.

Clause 61. A kit comprising the apparatus of any of the preceding clauses comprising: i) the apparatus configured to be assembled or disassembled including a tube, base, a chamber, packaging, container, and instructions for assembling, disassembling, and cleaning.

Clause 62. The kit of clause 61 further including a stem or bowl, wherein the stem or bowl are encompassed in packaging to protect each during shipment.

Clause 63. The kit of clauses 61 and 62 further including a cleaning brush and solution configured for cleaning the apparatus.

Clause 64. The kit of clauses 61-63 further including a container for storing or transporting the apparatus.

Clause 65. The apparatus of any of the preceding clauses, wherein the opening formed in the outlet, the opening formed in the inlet, the opening formed in the top of the chamber, the opening formed in the bottom of the chamber, and the opening formed in the top of the base each have a similar shape chosen from circular, oval, triangular, square, rectangular, star, clover, or polygon.

Clause 66. The apparatus of any of the preceding clauses, wherein the donor or acceptor connected to the inlet and the donor or acceptor connected to the top of the chamber are configured to removably secure and separably couple together.

Clause 67. The apparatus of any of the preceding clauses, wherein the donor or acceptor connected to the bottom of the chamber and the donor or acceptor connected to the top of the base are configured such that they may be coupled together.

Clause 68. The apparatus of any of the preceding clauses, wherein the donor or acceptor connected to the top of the chamber and the donor or acceptor connected to the bottom of the chamber have a similar shape.

Clause 69. The apparatus of any of the preceding clauses, wherein the donor or acceptor connected to the top of the chamber and the donor or acceptor connected to the bottom of the chamber have a different shape.

Clause 70. The apparatus of any of the preceding clauses, wherein the internal surface of the tube, the internal surface of the chamber, and the internal surface of the base are configured to form a watertight and continuous internal vessel when removably secured together.

Clause 71. The apparatus of any of the preceding clauses, wherein the tube, the chamber, and the base are connected to form the assembled apparatus having i) an internal surface, and ii) an external surface, wherein the internal surface forms a water-tight vessel having an opening formed by the outlet of the tube.

Clause 72. The apparatus of clause 71, wherein the external surface forms a shape mimicking the internal surface.

Clause 73. The apparatus of clause 71, wherein the external surface forms a different shape than the internal surface.

Clause 74. The apparatus of any of the preceding clauses, wherein the base has a surface opposite the opening formed at the top.

Clause 75. The apparatus of any of the preceding clauses, wherein the threading includes at least two, at least three, at least four, at least five, or at least six threads.

Clause 76. The apparatus of any of the preceding clauses 3-75, wherein the non-porous material includes antimicrobial properties.

Clause 78. The apparatus of any of the preceding clauses 3-75, wherein the non-porous material is capable of maintaining structural integrity when exposed to temperatures of about −15° C. to about 160° C.

Clause 79. The apparatus of any of the preceding clauses, wherein the apparatus is translucent or transparent.

Clause 80. The apparatus of any of the preceding clauses, wherein the apparatus is formed from recyclable food grade ABS material.

Clause 81. The apparatus of any of the preceding clauses, wherein the material forming the apparatus includes color.

BRIEF DESCRIPTION OF THE FIGURES

The detailed description particularly refers to the following figures, in which.

DETAILED DESCRIPTION

Figure 1:
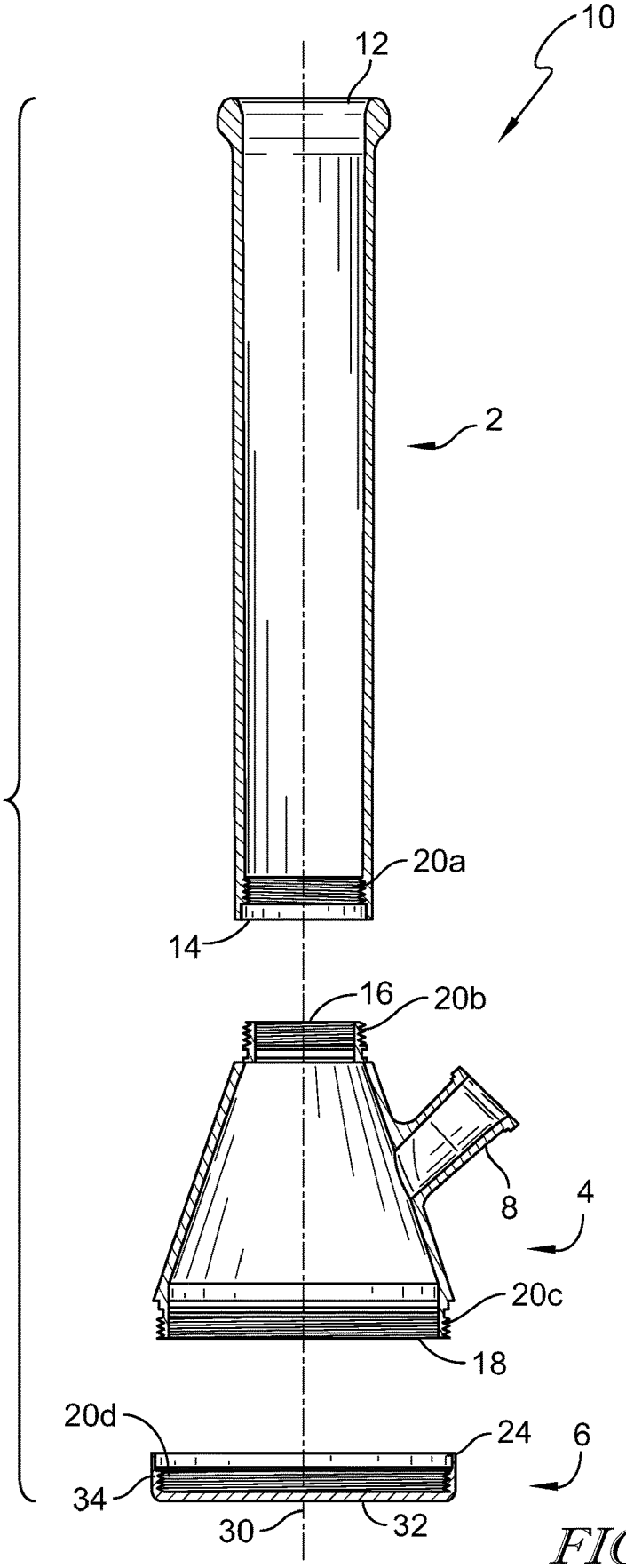
FIG. 1 is an exploded view of an illustrative embodiment of an apparatus, showing a tube, a chamber, and a base.

While the concepts of the present disclosure are susceptible to various modifications and alternative forms, specific exemplary embodiments are shown by way of example in the drawings and will be described in further detail. It should be understood that there is no intent to limit the embodiments of the present disclosure to the particular forms disclosed, but on the contrary, the intention is to cover all modifications, equivalents, and alternatives falling within the spirit and scope of the invention as defined by the appended claims.

An apparatus for use as a water pipe capable of being disassembled for cleaning and assembled for use is provided. Water pipes are susceptible to microbial growth and can become unsanitary. Generally, these apparatuses are difficult to sufficiently clean because the internal components are not easily accessible. Further, it can be difficult to determine that the internal surfaces of the apparatus are clean when the internal surfaces are not visible for inspection. The apparatus described herein is comprised of several components that are removably secured from each other. The points of attachment are advantageous because they are located in areas that are typical of tar and microbial growth, thus allowing a user to disassemble the apparatus into its discreet components for cleaning and inspection. The attachment points (referred to herein as a "fastener system") include structural features that provide structural integrity to the apparatus while it is disassembled, cleaned, assembled, and used for its intended purpose.

Referring to FIG. 1, in an illustrative embodiment, an apparatus 10 is provided that includes a tube 2, a chamber 4, and a base 6. The apparatus 10 may be disassembled to clean each component (2, 4, 6) and assembled to form a water pipe. When assembled into the apparatus 10, the tube 2 may be removably coupled to and in fluid communication with the chamber 4. The chamber 4 may be removably coupled to and in fluid communication with the tube 2, and the base 6 may be removably coupled to and in fluid communication with the chamber 4 to allow for disassembly of the apparatus 10, the tube 2 may be configured to be separable from the chamber 4, the chamber 4 may be configured to be separable from the tube 2 and/or the base 6, and the base 6 is configured to be separable from the chamber 4. In this way, the components (2, 4, 6) are configured to be assembled and disassembled in any order.

When assembled, the apparatus 10 includes an external portion formed by an external surface and an internal portion formed by an internal surface. The internal portion of the apparatus 10 forms a watertight vessel having an opening at the top. The vessel may be configured to hold a liquid to filter smoke. To aid in cleaning the internal surface may be smooth. In some aspects, the internal surface does not include any sharp corners.

When the apparatus 10 is assembled, the geometry of the external portion may mimic the geometry of the internal portion. Alternatively, the external portion may include a different geometry than the internal portion. For example, the internal surface may form a smooth, rounded vessel and the external surfaces may include corners and flat surfaces.

When the apparatus 10 is disassembled, the tube 2, the chamber 4, and the base 6 may be separated from each other into individual components. Accordingly, the base 6 is configured to be separable from the chamber 4, the chamber 4 is configured to be separable from the base 6 and tube 2, and the tube 2 is configured to be separable from chamber 4. In this way, each of the components is capable of being individually cleaned. Additionally, when the tube 2, the chamber 4, or the base 6 is isolated, the internal surfaces are easier to clean and visually inspect for cleanliness as discussed below.

The apparatus 10 may be formed of glass, a polymer, a metal, a ceramic, or a combination thereof. The apparatus 10 may be formed of any material and coated with a non-porous coating such as glass, a polymer, or ceramic. The apparatus 10 may be formed from a polymer such as plastic, polycarbonate, acrylic, or a combination thereof. In some embodiments, the apparatus 10 includes recyclable food grade ABS material. To aid in cleanliness, the apparatus 10 may be formed of a material or materials that are transparent or translucent allowing for visual inspection of the components. While partially or completely translucent, the apparatus 10 may include tinting or coloring on at least a portion of the apparatus.

While the apparatus 10 is improved by its ability to be disassembled and assembled, the materials to form the apparatus 10 and its structural elements are also capable of withstanding changes in temperature, exposure to solvents, and applied pressure while maintaining structural integrity. Structural integrity refers to the apparatus 10 having the physical properties to function for its intended purpose, for example mechanical strength, toughness, hardness, weight, and elasticity. The apparatus 10 is configured to withstand its intended loading without failing due to fracture, deformation, or fatigue. In one aspect, the apparatus 10 is capable of disassembly, cleaning, and reassembly without losing physical properties such as mechanical strength, toughness, and elasticity. The structural integrity is not altered by the process of assembling, disassembling, cleaning, sanitizing, or using the apparatus 10. Specifically, the donor or the acceptor (20*a*, 20*b*) and each component maintain structural integrity when coupling and uncoupling the components (2, 4, 6) of the apparatus 10. The structural integrity of the apparatus 10 and the components (2, 4, 6) is maintained over the desired service life. In some embodiments, the desired service life is at least six months, at least one year, at least one and a half years, at least two years, at least two and a half years, at least three years, at least four years, at least five years, or at least six years.

The apparatus 10 may be configured to maintain structural integrity even when exposed to temperatures up to about 160° C. Additionally, the apparatus 10 may be configured to maintain structural integrity when exposed to temperatures as low as −15° C. In some embodiments, the apparatus 10 may maintain structural integrity when exposed to temperatures ranging from about −15° C. to about 160° C.

The apparatus 10 may be subjected up to about 10,000 psi and still be capable of maintaining structural integrity. Additionally, each component (2, 4, 6) may be configured to withstand applied pressure as they are assembled into the apparatus 10 and disassembled into individual components (2, 4, 6). The tube 2 may couple and uncouple to the chamber 4 by an applied force of up to about 70 Newtons while maintaining structural integrity. Similarly, the base 6 may couple and uncouple from the chamber 4 by an applied force of up to about 70 Newtons. For example, where the tube 2 and chamber 4 are coupled together forming a fastener system such as complementary threading, the tube 2 and chamber 4 may be coupled by rotating the components (2, 4) about an axis 30 (as shown in FIG. 1) to interconnect the donor threading and acceptor threading by a force of up to about 70 Newtons without damaging the fastener system and disrupting the watertight seal formed in the internal portion. Further, the threading may be configured to reduce or prevent wear from repeated rotations. The fastener system for coupling and uncoupling will be described in further detail.

The apparatus 10 includes at least one type of fastener system to removably secure the components (2, 4, 6) together forming a watertight vessel for smoking plant base materials. The apparatus 10 may have one fastener system, two fastener systems, three fastener systems, four fastener systems, five fastener systems, or six fastener systems. The fastener systems are attachment points and are configured to removably secure the components during assembly and configured to be separable during disassembly while maintaining structural integrity. The fastener system includes a donor connected to one component (e.g., the tube 2) and an acceptor connected to another component (e.g., the chamber 4). The donor and acceptor are configured to removably secure and/or separably couple the components. In some embodiments, the fastener system may include complementary threaded structures where one component includes donor threading disposed on the external surface of the component and the other component includes acceptor threading disposed in the internal surface of the other component. As illustrated in FIG. 1, acceptor 20*a* is connected to the inlet 14 and donor 20*b* is connected to the top 16 of the chamber 4. Alternatively, the threaded structure 20*a* may be a donor and the threaded structure 20*b* may be an acceptor. Similarly, the base 6 may include an acceptor 20*d* configured to removably secure to the donor 20*c* located at the bottom 18 of chamber 4. Alternatively, the threaded structure 20*c* may be an acceptor and the threaded structure 20*d* may be a donor. In some aspects, the threaded structures 20*a*, 20*b*, 20*c*, and 20*d* individually may include at least two, at least three, at least four, at least five, or at least six threads. The fastener system may be any mechanism known to removably secure two components together to form a watertight seal including but not limited to: magnets, suction, threading, spring pressure, twist-and-lock, latches, or clasps. While the fastener system is not intended to be limiting, the following illustrative embodiments will focus on a fastener system utilizing complementary threaded structures to removably secure the components (2, 4, 6) together.

The fastener system may include additional material such as an additional layer of plastic, acrylic, or polycarbonate to enhance the mechanical strength at the attachment points. In some embodiments, the donor threaded structures and the acceptor threaded structures may include an additional polymer, metal, ceramic or a combination to increase hardness and reduce wear.

Figure 2:
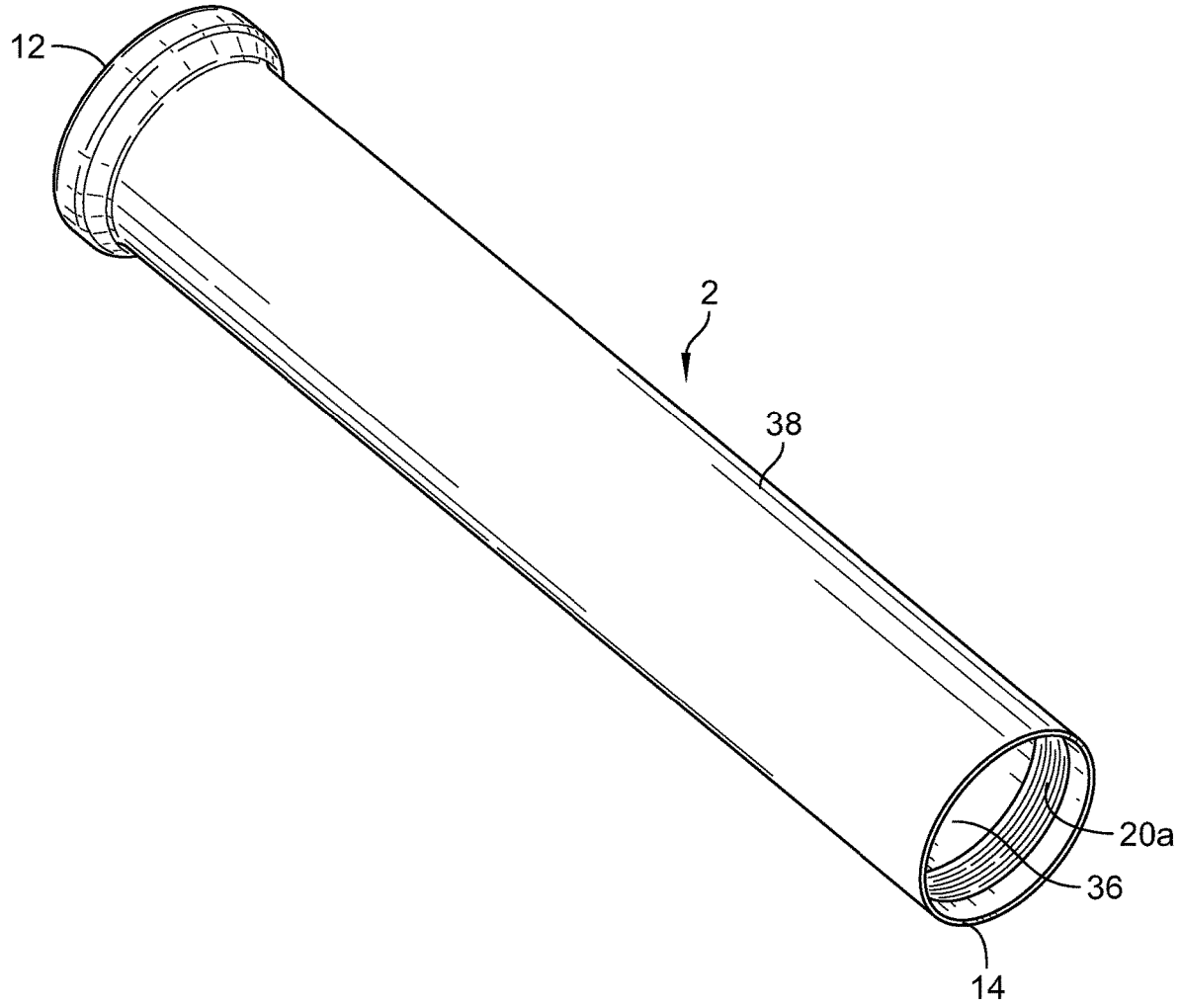
FIG. 2 is a perspective view of an illustrative tube.

When assembled for use, the top component of the apparatus 10 is the tube 2. Referring to FIG. 2, the tube 2 is shown as a hollow, elongated cylinder having an inlet 14 on an end of the tube 2 and an outlet 12 on the opposite end. The tube 2 includes an internal surface 36 and an external surface 38. The inlet 14 is configured to receive smoke from the chamber 4, and the outlet 12 is configured to deliver smoke to a user. The tube 2 may have a length of about 25 millimeters (mm) to about 1000 mm. The tube 2 may have a length of about 25 mm, about 50 mm, about 75 mm, about 100 mm, about 125 mm, about 150 mm, about 175 mm, about 200 mm, about 225 mm, about 250 mm, about 275 mm, about 300 mm, about 325 mm, about 350 mm, about 375 mm, about 400 mm, about 425 mm, about 450 mm, about 475 mm, about 500 mm, about 525 mm, about 550 mm, about 575 mm, about 600 mm, about 625 mm, about 650 mm, about 675 mm, about 700 mm, about 725 mm, about 750 mm, about 775 mm, about 800 mm, about 825 mm, about 850 mm, about 875 mm, about 900 mm, about 925 mm, about 950 mm, about 975 mm, or about 1000 mm. In an exemplary embodiment, the tube 2 has a length of about 270 mm.

The tube 2 may have a uniform thickness through the length of the tube 2. In some aspects, the internal surface 36 of the tube 2 is rounded similar to a cylinder as illustrated in FIG. 2. The inlet 14 may include a donor or acceptor threaded structure 20*a* configured to removably secure the tube 2 to the chamber 4. Referring to FIG. 2, in some embodiments, the threaded structure 20*a* is disposed on a portion of the inlet 14. When the threaded structure 20*a* is disposed on the internal surface 36 of the tube 2 and acts as an acceptor, such that inlet 14 is configured to receive the chamber 4. Alternatively, the threaded structure 20*a* is disposed on the external surface 38 of the tube 2 and acts as a donor, such that the chamber 4 is configured to receive the inlet 14.

In an illustrative embodiment, the threaded structure 20*a* disposed on a portion of the inlet 14 contacts the chamber 4 and rotates about the axis 30 to removably secure the tube 2 and chamber 4. The connection may form a watertight seal between the tube 2 and the chamber 4.

The outlet 12 may be opposite the inlet 14. In some embodiments, the outlet 12 is designed for a user to comfortably place a mouth over or within the outlet 12 to suction smoke through the inlet 14 towards the outlet 12. The inlet 14 and the outlet 12 may each be annular, although the outlet 12 may be any shape desirable to an end user. When the inlet 14 and outlet 12 are annular or circular in shape, the diameter of each may be about equal. In some aspects, the inlet 14 and outlet 12 may each independently have a diameter of between about 25 millimeters to about 125 millimeters. The diameter of the inlet 14 or outlet 12 may be about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, about 105 mm, about 110 mm, about 115 mm, about 120 mm, or about 125 mm. In some embodiments, the inlet 14 or the outlet 12 has a diameter ranging from about 40 mm to about 50 mm.

Figure 7:
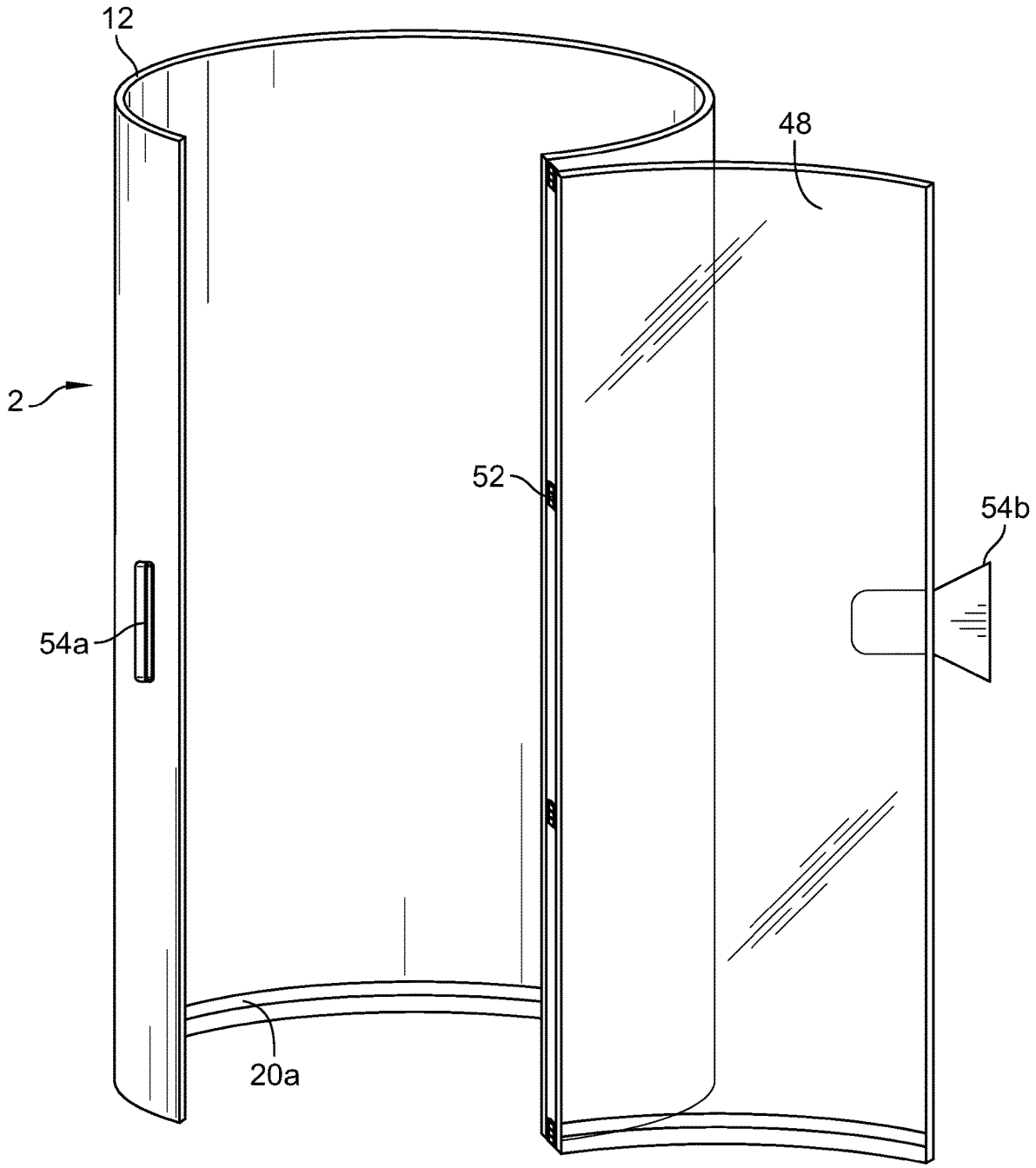
FIG. 7 is a side view of an illustrative embodiment with a hinged door coupled to the tube.

Jumping to FIG. 7, an additional embodiment of the tube 2 is shown. The tube 2 may include a hinged door 48. The door 48 may extend the length of the tube 2 or a portion of the tube 2. The hinged door is coupled to the tube 2 by one or more hinges 52. The door 48 may be temporarily closed and locked by a locking mechanism 54*a*,54*b*. In one aspect, the locking mechanism 54*a*,54*b* is a latch or two magnets. In operation, the hinged door 48 may be opened into an open position exposing the internal surface 36, and closed in a close position wherein the locking mechanism 54*a*,54*b* temporarily locks the door 48. When closed, the door 48 may form a seal so that filtered smoke does not escape around the door 48 but through the outlet 12.

Figure 3:
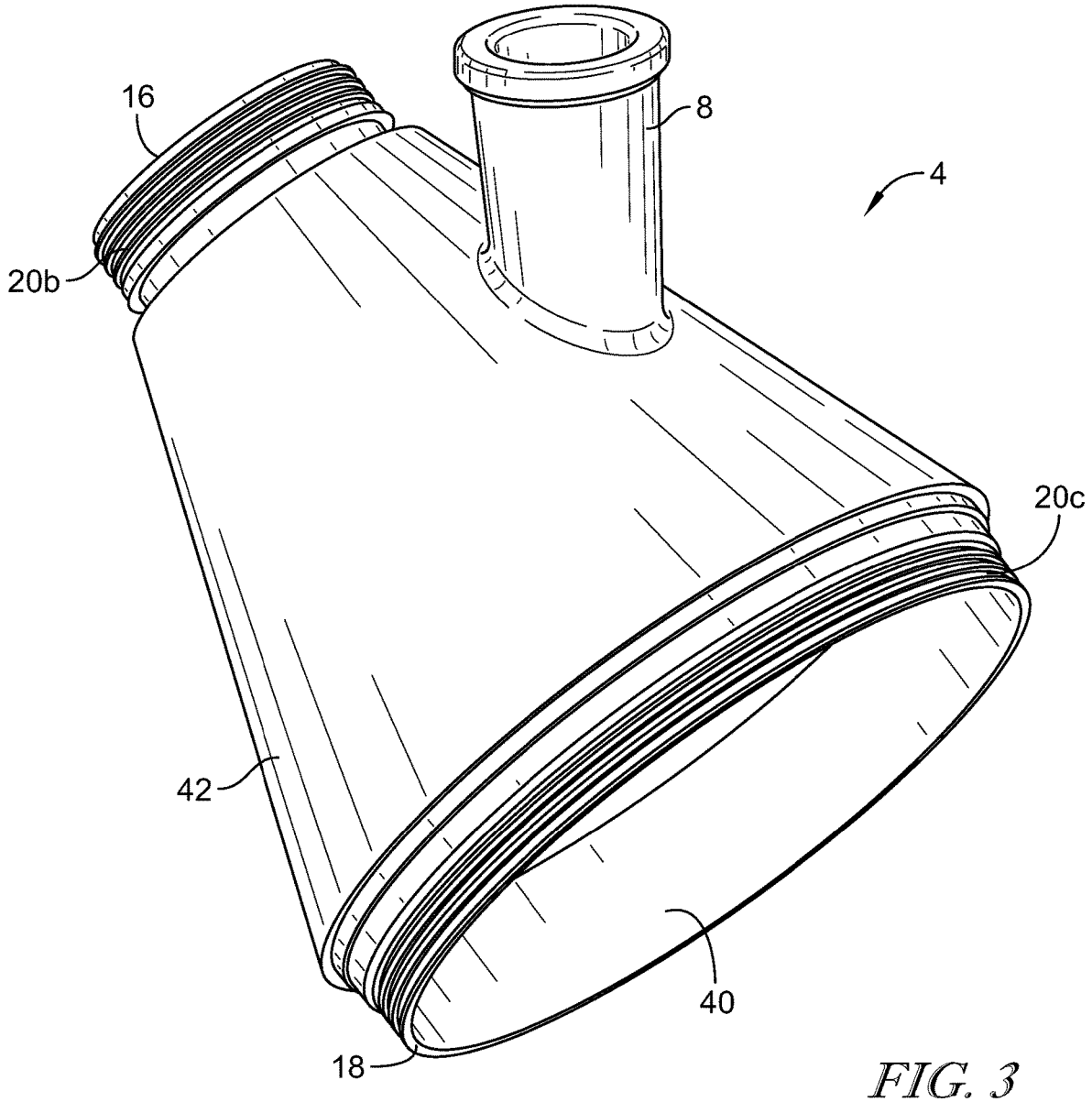
FIG. 3 is a perspective view of an illustrative chamber.

Referring to FIG. 1, the chamber 4 is coupled between the tube 2 and base 6 when the apparatus 10 is assembled. Referring to FIG. 3, the chamber 4 includes a hollow body having an internal surface 40, an external surface 42, a top 16 forming an opening, and a bottom 18 forming an opening. In some embodiments, the top 16 and the bottom 18 are annular so that the openings formed in the top 16 and bottom 18 are circular.

Additionally, the chamber 4 may include a joint 8 extending outwardly from the chamber 4, so that the joint defines a conduit in fluid communication with the chamber 4, as shown in FIG. 1 and FIG. 3. The joint 8 may be configured to receive a stem configured to couple to a bowl.

The top 16 may include a donor or acceptor threaded structure 20*b* configured to separably couple the chamber 4 from the tube 2. In an illustrative example, the top 16 interacts with the inlet 14 to removably secure to each other. The threaded structure 20*b* may be disposed on a portion of the top 16. The threaded structure 20*b* may be disposed on the external surface of the chamber 4 as shown in FIG. 1, acting as a donor, such that the inlet 14 including threaded structure 20*a* disposed on the internal surface 36 receives/accepts and removably secures to the threaded structure 20*b*. Alternatively, the threaded structure 20*b* may be disposed on the internal surface 40 of the chamber 4 acting as an acceptor. In this embodiment, the top 16 receives the threaded structure 20*a*, which is disposed on the external surface 38 of the tube 2. In this way, the diameter of the top 16 is similar in size to the inlet 14 so that the two may interconnect. Accordingly, the top 16 may have a diameter of between about 25 millimeters to about 125 millimeters.

Figure 5:
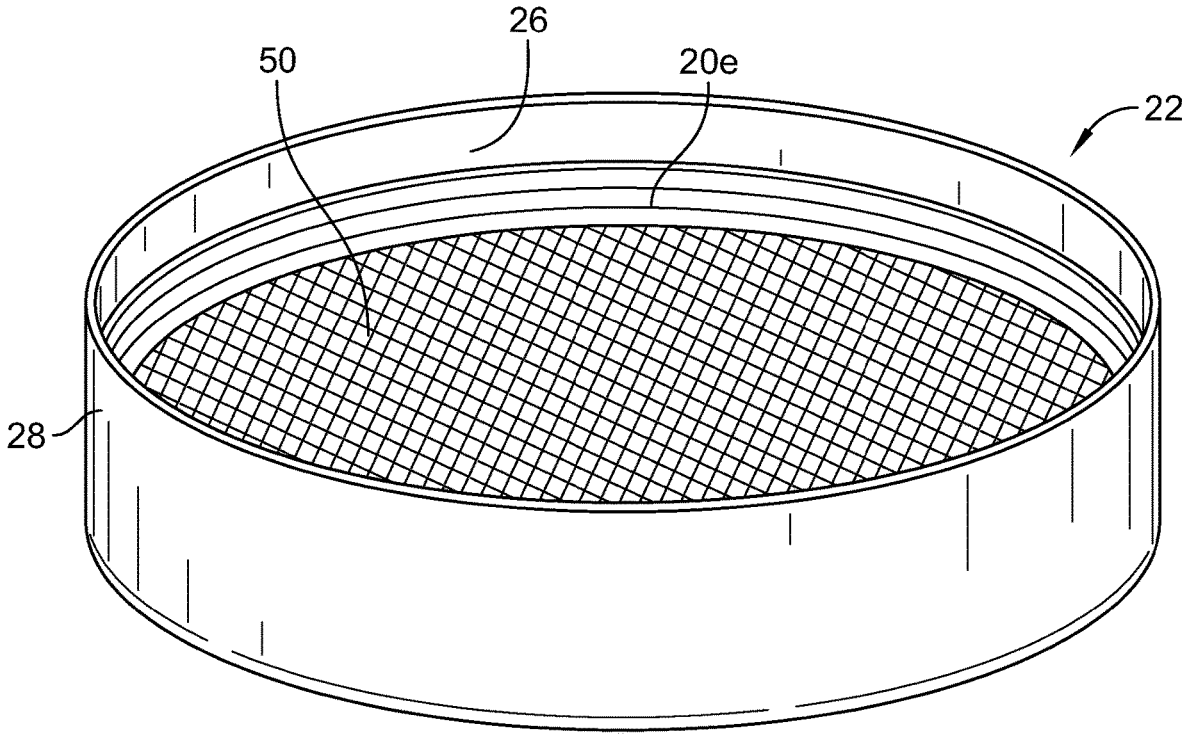
FIG. 5 is a perspective view of an illustrative intermediate piece.
Figure 6:
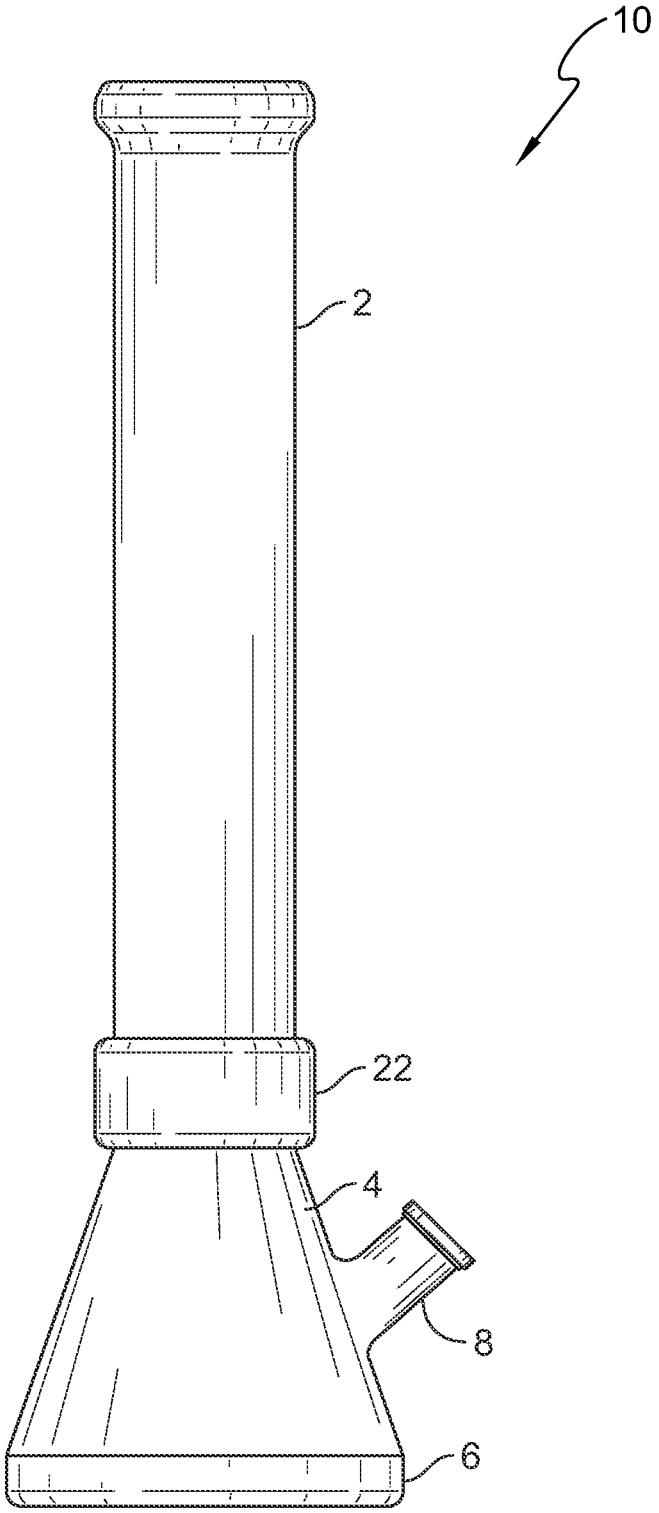
FIG. 6 is a side view of an illustrative apparatus including a tube, an intermediate piece, a chamber, and a base.

Referring to FIG. 5 and FIG. 6, the apparatus 10 may further include an intermediate piece 22. The intermediate piece 22 may be employed to couple the tube 2 and the chamber 4. The intermediate piece 22 has an external surface 28 and an internal surface 26. A threaded structure 20*e* may be disposed on the internal surface 26 or external surface 28. In an alternative embodiment, the top 16 is coupled to the inlet 14 by the intermediate piece such that the top 16 and inlet 14 both include threaded structures 20*a*, 20*b* on their respective external surfaces, and the intermediate piece 22 includes threaded structure 20*e* disposed on the internal surface 26 capable of receiving the threaded structure 20*a* and threaded structure 20*b*. In some embodiments, the threaded structure 20*a* is disposed on the internal surface 36 of the tube 2, and the threaded structure 20*b* is disposed on the internal surface 40 of the top 16 of the chamber 4. Threaded structure 20*a* and threaded structure 20*b* accept the intermediate piece 22 having a threaded structure 20*e* on the external surface 28. The tube 2 and chamber 4 are configured to be separable from the intermediate piece 22 by rotating about the axis 30 to secure and reverse rotating about the axis 30 to separate. In some embodiments, the intermediate piece 22 may include a threaded structure 20*e* configured in part to act as acceptor and in part configured as a donor. In this way, the intermediate piece 22 may receive a threaded structure 20*a* or 20*b* and includes a donor threaded structure configured to be received by threaded structure 20*a* or 20*b*.

Turning to FIG. 5, the intermediate piece may include a porous surface 50 extending the length of the diameter of the intermediate piece 22. In some aspects, the porous surface 50 may hold ice or pleasant smelling herbs while the smoke travels from the chamber 4 into the tube 2. Alternatively, the intermediate piece 22 may include a material that changes color based on changes in pH or temperature. When the porous surface 50 is present, the threaded structures 20*a* and 20*b* may be located on either side so that the porous surface 50 is about in the middle of the intermediate piece 22.

Turning back to FIG. 3, the bottom 18 may be located opposite the top 16. The diameter of the opening formed by the bottom 18 may be of a similar length as the top 16. Alternatively, the bottom 18 may have a larger diameter than the top 16 as illustrated in FIG. 1 and FIG. 3. In some embodiments, the opening formed in the bottom 18 may have a diameter of between about 25 millimeters to about 310 millimeters.

As with the top 16, the bottom 18 may include a threaded structure 20*c* acting as a donor or acceptor to removably secure the chamber 4 to the base 6. The threaded structure 20*c* may be disposed on the external surface 42 of the chamber 4. Alternatively, the threaded structure 20*c* may be disposed on the internal surface 40 of the chamber 4. In this way, the threaded structure 20*c* may be received by or may accept the base 6. As illustrated in FIG. 3, the bottom 18 includes a threaded structure 20*c* disposed on the external surface 42 of the chamber 4.

Figure 4:
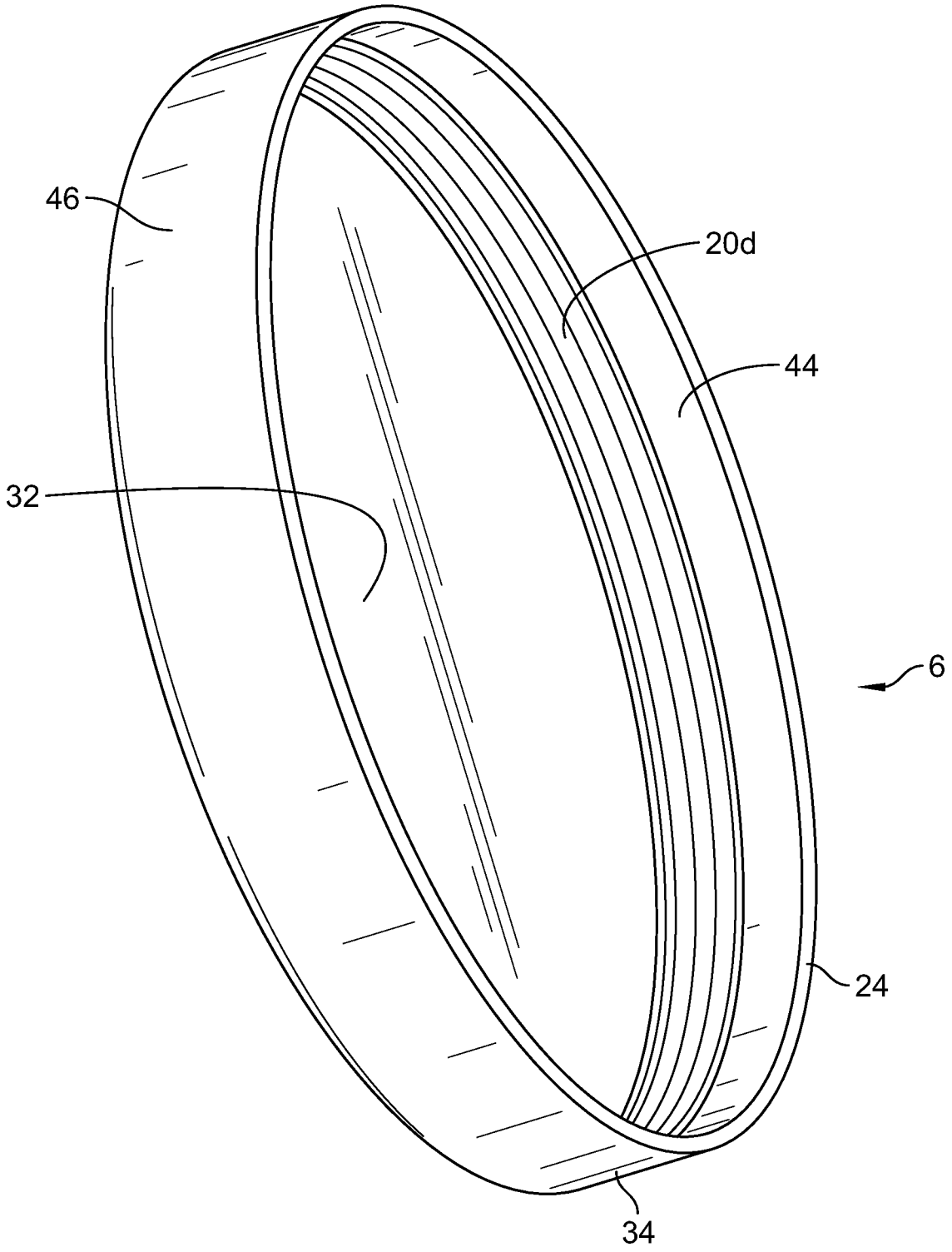
FIG. 4 is a perspective view of an illustrative base.

Referring to FIG. 4, the base 6 may be configured to be removably secured to chamber 4. The base 6 may include a foundation 32 having a wall 34 extending outwardly therefrom and surrounding the foundation 32. The base 6 has an internal surface 44 and an external surface 46. The top 24 of the wall 34 forms an opening configured to couple to the bottom 18 of the chamber 4. In one illustrative embodiment, the base 6 is similar to an end cap. In order to removably secure the base 6 to the chamber 4, the wall 34 may include a threaded structure 20*d* disposed on a portion of the top 24. In one embodiment, the threaded structure 20*d* is disposed on the internal surface 44 of the base 6. The threaded structure 20*d* may be configured to receive the threaded structure 20*c* disposed on the external surface 46 of the chamber 4. In operation, the threaded structure 20*c* and/or the threaded structure 20*d* are rotated about the axis 30 to removably secure the chamber 4 and the base 6 together. Accordingly, the diameter of the top 24 may be between about 25 millimeters to about 310 millimeters. The surrounding wall 34 of base 6 may have a height of about 5 millimeters to about 160 millimeters.

Additionally, the threaded structures 20*a*, 20*b*, 20*c*, and 20*d* may each include a gasket. The gasket may be made of any suitable materials including plastics, rubbers, silicone, or a combination thereof. When present, the gasket is configured to provide a watertight seal between the chamber 4 and the base 6 and the chamber 4 and the tube 2.

When the chamber 4 is coupled to the base 6, the internal portion formed therein from internal surfaces 40 and 44 is configured to hold a liquid for filtering smoke. The internal portion formed from the chamber 4 coupled to the base 6 may be configured to hold a volume of liquid up to about 500 $mL^3$. The internal portion may be configured to hold a liquid and a coolant such as ice.

A kit is provided comprising the apparatus 10 configured to be assembled or disassembled including a tube 2, a base 6, a chamber 4, packaging, container, and instructions for assembling, disassembling, and cleaning. In some embodiments, the kit also includes the intermediate piece 22 and/or gaskets. The kit may further include a stem and/or bowl encompassed in their own packaging to protect each during shipment. The kit may include a cleaning brush and solvent formulated for cleaning the apparatus 10. Additionally, the kit may include a case or a travel bag for storing or transporting the apparatus 10 assembled or disassembled into its components (2, 4, 6).

Further provided herein are methods of assembling and disassembling the apparatus 10. A method of assembling the apparatus 10 may include the steps of i) connecting the chamber 4 having a threaded structure 20*c* to the base 6 having a threaded structure 20*d*; ii) rotating the base 6 or chamber 4 to interconnect the threaded structure 20*c* with threaded structure 20*d*; iii) connecting the chamber 4 having a threaded structure 20*b* to the tube 2 having a threaded structure 20*a*; iv) rotating the chamber 4 or tube 2 to interconnect the threaded structure 20*b* with threaded structure 20*a*.

A method of disassembling the apparatus 10 may include the steps of i) rotating the tube 2 or chamber 4 to disconnect the fastener system (20*a* and 20*b*); ii) separating the tube 2 from the chamber 4; iii) rotating the base 6 or chamber 4 while keep the other stationary to disconnect the fastener system (20*c* and 20*d*); and iv) separating the chamber 4 and the base 6.

A method of cleaning the apparatus 10 may include the steps of i) providing the disassembled components of apparatus 10 including the tube 2, base 6, and chamber 4 to a mechanism for cleaning. The apparatus 10 may also include the intermediate piece 22. The mechanism for cleaning may be selected from an ultraviolet light, a dishwasher, an autoclave, a vessel containing water, vinegar, lemon, or dish soap, or any such combination of these mechanisms. As each component can be individually cleaned and inspected, the apparatus 10 is capable of being cleaned thoroughly without guesswork.

The apparatus 10 may be easily disassembled into its various components including the tube 2, the chamber 4, and the base 6. In some embodiments, the apparatus 10 may include additional components including at least one gasket and/or an intermediate piece 22. Each of these components may be visually inspected and cleaned to remove tar and microbes. In one aspect, each component can be placed in a dishwasher to be cleaned and dried. Afterwards, each piece can be visually inspected, especially around areas notorious for tar and microbe growth. Current water pipes cannot be disassembled to easily access and inspect the internal surface. The apparatus 10 is also configured to disassemble less than all the components to inspect and clean. Generally, water pipes are a single piece with no points of attachment that form a watertight seal, they also tend to be bulky and difficult to manipulate for cleaning and inspection.

The invention claimed is:

1. An apparatus for use as a water pipe comprising:

i) a tube having an inlet and an outlet, ii) a chamber having a top and a bottom, iii) an intermediate piece having a threaded structure configured to removably secure the tube, the intermediate piece, and the chamber together; wherein the intermediate piece further includes a porous surface extending the length of the diameter of the intermediate piece, iv) a base;

wherein the base is configured to be separable from the bottom of the chamber, the top of the chamber is configured to be separable from the intermediate piece, and the intermediate piece is configured to be separable from the inlet; and wherein the apparatus is configured to be disassembled and reassembled.

2. The apparatus of claim 1, wherein the tube includes an internal surface and an external surface and wherein a threaded structure is disposed on the internal surface on a portion of the inlet.

3. The apparatus of claim 1, wherein the chamber includes an internal surface and an external surface, and wherein a threaded structure is disposed on the external surface on a portion of the top of the chamber.

4. The apparatus of claim 1, wherein the bottom of the chamber further includes a threaded structure disposed on the external surface.

5. The apparatus of claim 4, wherein the base includes an internal surface, and wherein threading is disposed on the internal surface.

6. The apparatus of claim 5, wherein the base removably secures to the chamber by interconnecting threading.

7. The apparatus of claim 1, wherein a watertight internal portion is formed from the tube having an internal surface coupled to the intermediate piece having an internal surface, the intermediate piece coupled to the chamber having an internal surface, and the chamber coupled to the base having an internal surface.

8. The apparatus of claim 1, wherein the intermediate piece includes an internal surface and an external surface and wherein a threaded structure is disposed on the internal surface on a portion of the intermediate piece.

9. The apparatus of claim 1, wherein the tube includes an internal surface and an external surface and wherein a threaded structure is disposed on the external surface on a portion of the inlet.

10. The apparatus of claim 9, wherein the tube and the intermediate piece are configured to removably secure by rotation about an axis.

11. An apparatus configured to be assembled and disassembled comprising:

i) a tube having an inlet and an outlet;

ii) a chamber having a top with an opening formed therein and a bottom with an opening formed therein, wherein the inlet removably secures to the top of the chamber; and iii) an intermediate piece having a threaded structure configured to removably secure the tube, the intermediate piece, and the chamber together; wherein the intermediate piece further includes a porous surface extending the length of the diameter of the intermediate piece, and iv) a base having an opening, wherein the opening of the base removably secures to the bottom of the chamber.

12. The apparatus of claim 1, wherein the bottom of the chamber includes a threaded structure and the base includes a complementary threaded structure that interconnects to removably secure the chamber to the base forming a watertight seal.

13. The apparatus of claim 1, wherein the apparatus comprises a threaded structure on the inlet disposed on an external surface of the tube and a threaded structure on the top of the chamber disposed on an external surface of the chamber.

14. A kit comprising:

an apparatus including a tube, and intermediate piece, a chamber, and a base, wherein the tube is configured to be removably secured to the intermediate piece, the intermediate piece is configured to be removably secured to the chamber, and the chamber is configured to be removably secured to the base, wherein the intermediate piece further includes a porous surface extending the length of the diameter of the intermediate piece;

a container configured to transport the apparatus; and instructions for assembling, disassembling, cleaning and using.

15. The kit of claim 14 further including a solvent formulated to clean the apparatus.

* * * * *